United States Patent [19]

Drummond

[11] Patent Number: 4,471,161

[45] Date of Patent: Sep. 11, 1984

[54] CONDUCTOR STRAND FORMED OF SOLID WIRES AND METHOD FOR MAKING THE CONDUCTOR STRAND

[75] Inventor: John D. Drummond, Fort Wayne, Ind.

[73] Assignee: Essex Group, Inc., Fort Wayne, Ind.

[21] Appl. No.: 467,124

[22] Filed: Feb. 16, 1983

[51] Int. Cl.[3] ..... H01B 7/00; H01B 5/08; H01B 13/00

[52] U.S. Cl. ..... 174/110 R; 57/13; 57/58.52; 57/213; 174/130

[58] Field of Search ..... 174/119 R, 128 R, 130; 57/3, 6, 13, 16, 58.49, 58.52, 212, 213

[56] References Cited

U.S. PATENT DOCUMENTS

| | | | |
|---|---|---|---|
| 2,098,163 | 11/1937 | Reed | 174/128 R |
| 2,509,894 | 5/1950 | Toulmin, Jr. et al. | 174/128 R |
| 3,167,903 | 2/1965 | Peterson et al. | 57/212 |
| 3,934,395 | 1/1976 | Vryland | 57/6 |
| 3,945,182 | 3/1976 | Dover et al. | 57/58.52 |
| 4,275,262 | 6/1981 | Sellars | 174/128 R |
| 4,311,001 | 1/1982 | Glushko et al. | 57/6 |
| 4,349,694 | 9/1982 | Vives | 174/130 |

FOREIGN PATENT DOCUMENTS

| | | | |
|---|---|---|---|
| 1414136 | 11/1975 | United Kingdom | 57/6 |

OTHER PUBLICATIONS

Bellino, Robert A.; "How to Select a Multiconductor Cable"; *Insulation,* Dec., 1967, pp. 64–70.

*Primary Examiner*—G. P. Tolin
*Assistant Examiner*—Morris H. Nimmo
*Attorney, Agent, or Firm*—Gene D. Fleischhauer

[57] ABSTRACT

A conductor strand 12 for an electric cable 10 is disclosed. The conductor strand includes a solid first wire 16 having a longitudinal axis $A_1$, an inner layer of six solid wires 20 twisted helically about the first wire and an outer layer 24 formed of two different diameter wires. The outer layer includes six third wires 26 spaced circumferentially one from the other leaving a gap G therebetween. Disposed in each gap is a fourth wire 28 having a diameter which lies in a range of sixty-eight percent to seventy-eight percent of the diameter of the third wire. A method for making the cable is disclosed which includes the steps of helically twisting the inner layer about the first wire with a lay greater than the lay of the finished conductor, twisting the outer layer of wires about the inner layer of wire with that greater lay, and twisting the outer and inner wires about the first wire to reduce the lay to the lay of the finished conductor strand.

25 Claims, 8 Drawing Figures

FIG. 4
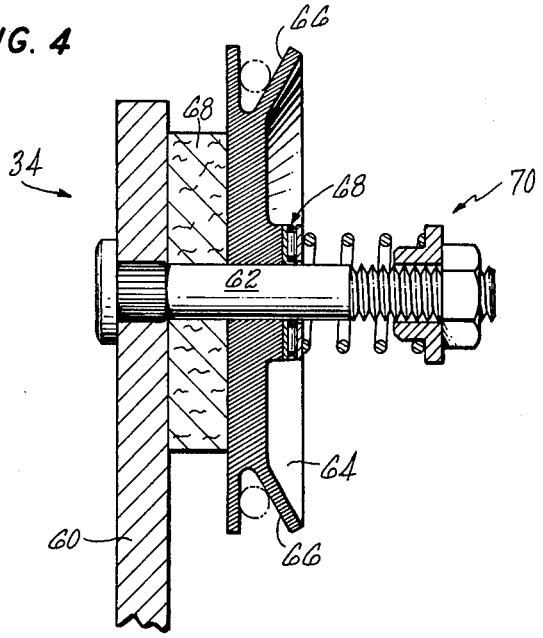
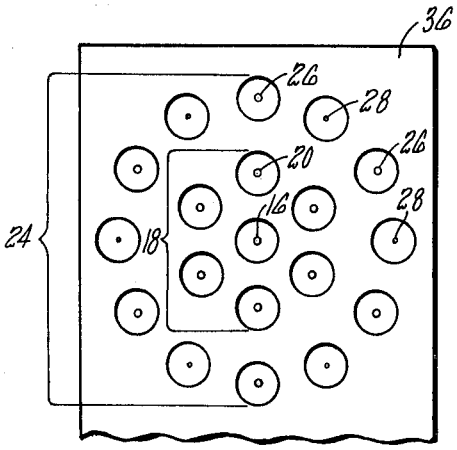
FIG. 5
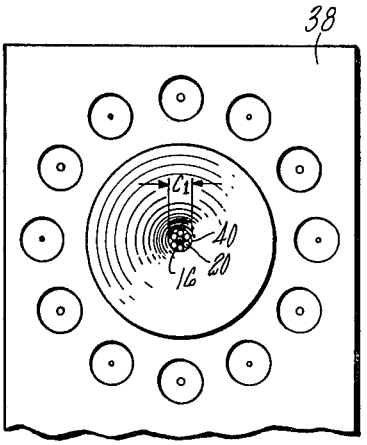
FIG. 6

CONDUCTOR STRAND FORMED OF SOLID WIRES AND METHOD FOR MAKING THE CONDUCTOR STRAND

TECHNICAL FIELD

This invention relates to a conductor strand of the type used in electric cables which is formed of a plurality of round, solid wires twisted together to form a unit and a method for making the conductor strand.

BACKGROUND ART

Multi-wire electrical conductor strands are made in different configurations by many different methods. Each method and each configuration has advantages and disadvantages.

One approach is to form the strand with a central wire surrounded by one or more layers of helically laid wires. The strand is made by twisting the wires of each layer about the central wire with a wire twisting machine. A true concentric strand is one example of a strand made by this method. Each layer of a true concentric strand has a reverse lay and an increased length of lay with respect to the preceding layer. In the case of a nineteen wire conductor strand, two passes are required through the wire twisting machine to make the strand: one pass for a six wire layer having a right hand lay over the central wire; and, a second pass for a twelve wire layer having a left hand lay over the inner layer. The two passes result in low productivity in comparison with machines that apply both layers of wire in a single pass.

A unilay strand is a second example of a conductor strand having helically laid layers disposed about a central wire. Each layer of wire of a unilay strand has the same direction of lay and the same length of lay. Because each layer has the same lay length and lay direction, the strand may be made in a single pass. As a result productivity increases.

Unilay strands are commonly used for 12 and 14 AWG conductor strands formed from nineteen separate wires. These strands are formed of nineteen wires of the same diameter twisted in a concentric pattern to form a hexagon as shown in FIG. 1. The wires may be twisted on either a single twist machine or on a double twist machine as discussed in Krafft, "Single Twist Bunching", WIRE JOURNAL 66 (October 1979). The single twist machine has advantages over double twist machines. Strands made on single twist machines are generally more uniform and of a smaller diameter than those formed on a double twist machine. This occurs because of the difficulty in a double twist machine of controlling the tension of the wires entering the closing die where the helical twist is applied to the wires as the number of wires in the strand is increased to nineteen wires. Double twist stranding machines have the advantage of higher productivity because each rotation of the flyer causes two twists of the wire. Moreover, because of differences between these machines, it is common to find double twist machines that are capable of operating at fifty percent (50%) higher rotational speeds than single twist machines. As a result the output of double twist machines is often greater than three times the output of single twist machines.

Unilay strands formed with nineteen wires of the same diameter, such as the diameter $D_5$ as shown in FIG. 1, are not without problems. As the six wires of the inner layer and the twelve wires of the outer layer are twisted about the central wire in the same way and in a concentric pattern, a hexagonal cross section is formed. The hexagonal cross section presents three basic problems.

1. Six voids V' formed by the sides of the hexagon are inside the circumscribing circle of insulation. These voids are filled with insulation requiring more insulation per unit length of wire as compared with true concentric stranding.
2. Experience has shown that wires at the corners of the hexagon tend to change position as they pass through circular dies because of difficulty in controlling tension. As the corner wires change position, forces act on the layers of wire and cause the wires of the inner layer to urge the wires of the outer layer to "pop out" resulting in a high strand, intermixing of the wires (i.e. "bird caging") and strand breaking.
3. The wires at the corners of the hexagon tend to backup because of the difficulty in controlling tension in the different layers. Backing up results in intermixing of the wires ("bird cages") and wire breaks during the extrusion of insulation.
4. A unilay strand in the finished condition tends to be more rigid than true concentric strands because the wires of each layer tend to reinforce the wires of the other layers against bending making the wires more difficult to work with than true concentric stranding.

As a result of these concerns, engineers in the conductor wire industry have been seeking to develop a conductor strand which increases the flexibility of unilay strands and which would permit the unilay strands to be made on a double twist machine for a wide variety of gages.

DISCLOSURE OF INVENTION

According to the present invention, a nineteen wire conductor strand has a core having a first lay of a first length which runs in a first direction and has an outer layer of twelve wires having two different diameter wires such that each outer wire is spaced circumferentially from at least one of the adjacent outer wires to permit small amounts of relative longitudinal movement between each of the outer wires.

In accordance with the present invention, a method for forming a conductor strand with a first lay includes the steps of: helically twisting a first layer of wires about a first wire, the first layer having a second lay which is larger than the first lay; helically twisting an outer layer of wires about the inner layer with a lay which is the same as the second lay; and, helically twisting the outer layer and the inner layer about the first wire to reduce the second lay to the first lay, the wires in the outer layer each being spaced circumferentially from at least one of the adjacent wires and being placed under tensions which are relatively constant in each layer to permit longitudinal adjustments between wires during twisting.

A primary feature of the present invention is a conductor strand formed of nineteen wires having an outer layer of twelve wires, each of which is spaced from at least one of the circumferentially adjacent pair of wires. The outer layer includes six wires of a first diameter and six wires of a second diameter smaller than the first wire. Each of the smaller wires is circumferentially disposed between an adjacent pair of larger wires having a first diameter. The second, smaller, diameter is equal to or greater than sixty-three percent of the first diameter and equal to or less than seventy eight percent of the diameter of the larger wire. In one embodiment, the first wire has a longitudinal axis and, at any section perpendicular to the longitudinal axis, each fourth wire is spaced circumferentially from the adjacent pair of third wires.

A primary advantage of the present invention is the flexibility of the conductor strand which results from the circumferential gap between wires in the outer layer of the conductor strand. Another advantage is the number of wire breaks and the number of high strands occuring per thousand feet of wire which results from the ability of the wire to accommodate relative longitudinal movement between layers. Still another advantage is the speed at which the conductor strand may be formed by double twisting the wire in a single pass through a wire twisting machine which results from the different levels of unit tension, the uniformity of tension within each layer, and the differences in diameters of the wires of the outer layer. An advantage is the savings in insulation used in forming an electrical cable which results from the substantially circular cross section of the conductor strand which enables sleeving a tubular layer of insulation over the conductor strand as compared with strands having a hexagonal shaped cross section which requires extruded insulation.

The foregoing features and advantages of the present invention will become more apparent in the light of the following detailed description of the best mode for carrying out the invention and in the accompanying drawing.

BRIEF DESCRIPTION OF THE DRAWING

FIG. 4 is a cross-sectional view taken along the lines 4—4 of FIG. 3.

FIG. 5 is a cross-sectional view taken along the lines 5—5 of FIG. 3 and shows a first lay plate.

FIG. 6 is a cross-sectional view taken along the lines 6—6 of FIG. 3 showing a second lay plate and a first closing die.

BEST MODE FOR CARRYING OUT THE INVENTION

Figure 2:
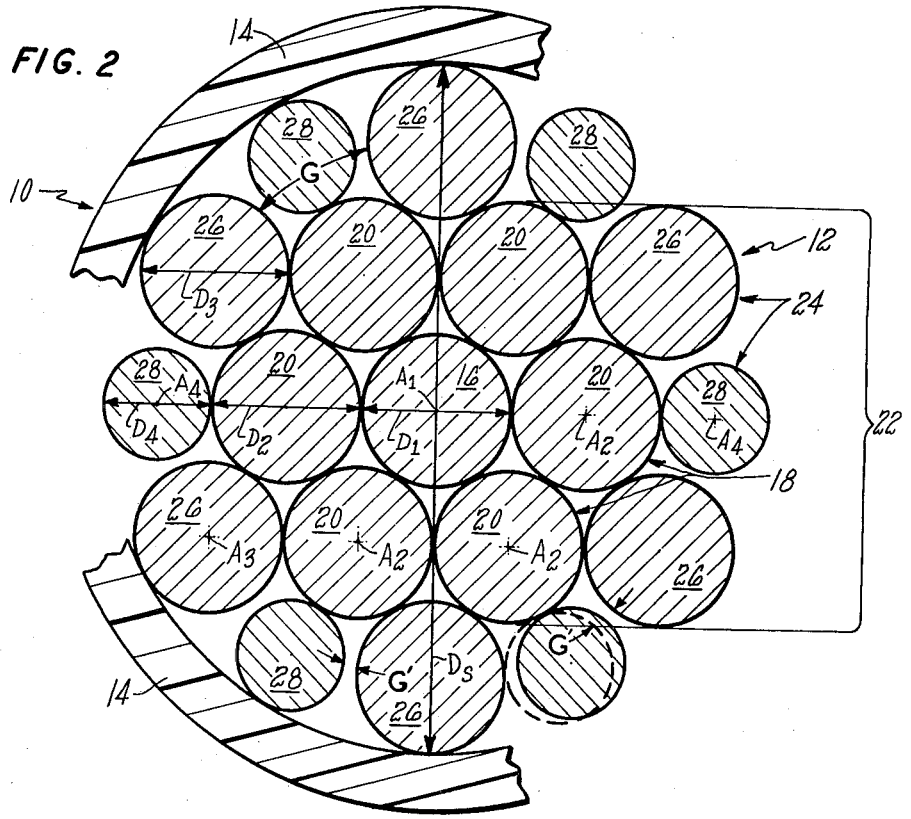
FIG. 2 is a cross-sectional view of an electric cable having a substantially circular cross section with a portion of the insulation broken away for clarity.

FIG. 2 shows a cross-sectional view of an electric cable 10. The electric cable has a conductor strand 12 and a layer of insulation 14. The conductor strand has a diameter Ds. The conductor strand is formed of nineteen round, solid wires each formed of an electrical conductor material. Electrical conductor materials include copper, aluminum and like materials having an electrical resistivity less than ten (10) microhm·cm. ($10^{-8}$ ohm-m).

The conductor strand 12 has a central wire such as the first wire 16. The first wire has a longitudinal axis $A_1$ and a cross-sectional shape which is round. The first wire has a diameter $D_1$.

An inner layer 18 of six second wires 20 is disposed circumferentially about the first wire 16. Each second wire has a longitudinal axis $A_2$ and has a cross-sectional shape which is round. Each second wire has a diameter $D_2$. The diameter $D_2$ is measured perpendicular to the longitudinal axis $A_2$ and is equal to the diameter $D_1$.

Each second wire 20 is helically wound about the first wire 16 with a first lay. The term "lay" is the axial length of one complete turn, or helix, of a wire in the stranded conductor. The length of the lay will typically lie in the range of eight times the diameter $D_s$ of the conductor strand to sixteen times the diameter $D_s$ of the conductor strand. The direction of a lay is the lateral direction in which the individual wires of the cable run over the top of the cable as the individual wires recede from an observer looking parallel to the longitudinal axis $A_1$. A right-hand lay recedes from the observer in clockwise rotation or like a right-hand screw thread; a left hand lay is the opposite. Each second wire has a first lay running in a first direction.

FIG. 2 is a cross-sectional view of a cable having a lay whose length is greater than 15 times the diameter $D_s$. The cross-sectional view is taken perpendicular to the longitudinal axis $A_1$. As a result of the direction of the lay in the lateral direction, the longitudinal axis $A_2$ of each second wire deviates slightly from a ninety degree angle with respect to the section. In theory, the result is a slightly elliptical cross-sectional shape at the cross section perpendicular to the axis $A_1$, but, because the deviation from the perpendicular is so small, the shape is round and appears circular as shown in FIG. 2.

The first wire 16 and the six second wires 20 of the inner layer 18 form a core 22 for the conductor strand 12.

The conductor strand has an outer layer 24 disposed circumferentially about the inner layer. The outer layer is formed of six third wires 26 and six fourth wires 28 each of which is disposed circumferentially about the inner layer. Each third wire is helically wound about the inner layer with a lay having the same length and direction as the first lay. Each third wire tangentially (peripherally) engages a pair of adjacent second wires 20. As will be realized, at some sections along a length of conductor strand, each third wire may not tangentially engage both of the adjacent second wires because of manufacturing tolerances of the machines used during production and small variations in the diameter of the individual wires.

Each third wire 26 is spaced circumferentially from the circumferentially adjacent third wires leaving a circumferential gap G therebetween. Each third wire has a longitudinal axis $A_3$ and a cross-sectional shape which is round. A diameter $D_3$ equal to the diameter $D_1$ is measured perpendicular to the axis $A_3$. Each fourth wire 28 is disposed in an associated circumferential gap G. Each fourth wire has a lay having the same length and direction as the first lay. Each fourth wire has a longitudinal axis $A_4$ and a cross-sectional shape which is round. The fourth wire has a diameter $D_4$ which is less than the diameter $D_1$ of the first wire. The diameter $D_4$ of each fourth wire lies in the range of sixty-eight percent (68%) to seventy-eight percent (78%) of the diameter $D_1$ of the first wire ($0.68\ D_3, D_2, D_1 \leqq D_4 \leqq 0.78\ D_1, D_2, D_3$).

As shown in FIG. 2 each fourth wire 28 is spaced away from at least one of the pair of adjacent third wires 26 leaving a minimum circumferential gap G' therebetween which is greater than 0. As shown by the broken line in FIG. 2, the fourth wire may tangentially engage one of the second wires 20 and one of the third wires 26 at some sections of the stranded conductor. In such a case, the minimum gap G' will increase. The spacing G', which results from the different diameters of the wire in the outer layer, increases the flexibility of the conductor as compared with constructions in which the wires tangentially engage each adjacent wire in the outer layer. While the phenomenon is not well understood, it is believed that this increase in flexibility results from an increased ability of the wire to accommodate relative longitudinal movement between layers.

Figure 1:
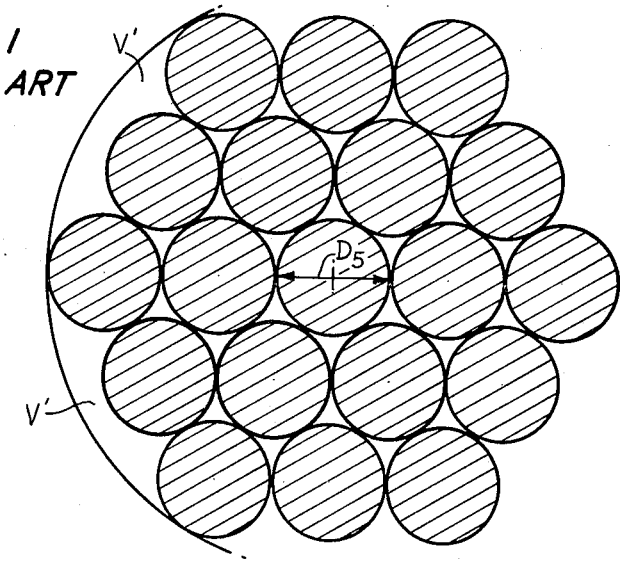
FIG. 1 PRIOR ART
FIG. 1 is a cross-sectional view of a prior art conductor strand.

The conductor strand 14 having nineteen wires has a substantially circular cross-sectional configuration. The cross-sectional configuration has a size in a gage range which ranges from 20 AWG to 0000 AWG. Each gage has a predetermined circular mil area $CMA_f$ which is the sum of the circular mil areas of each of the nineteen wires. A conductor strand having the same circular mil area or American Wire Gage may be formed of nineteen wires of equal size. Each wire will have a diameter $D_5$ as shown in FIG. 1 (FIG. 1 is not drawn to scale). The diameter $D_4$ in comparison with the same AWG conductor formed of 19 equal size wires of diameter $D_5$ is less than the diameter $D_5$ but the diameter $D_3$ of each third wire is greater than the diameter $D_5$. As a result, the conductor strand shown in FIG. 2 is substantially circular in comparison with the prior art conductor shown in FIG. 1. Because of the substantially circular cross section, the layer of insulation 14 may be sleeved as a tubular wall axially over the substantially circular conductor strand enabling the insulation layer to slidably engage the conductor strand to increase the flexibility of the electric cable. In comparison, the prior art conductor having a hexagonal cross section typically receives its layer of insulation by extruding the layer of insulation over the strand. Such extruded insulation does not slidably engage the conductor strand. Moreover, the substantially circular cross-sectional conductor shown in FIG. 2 requires less insulation even if the layer is extruded because the extruded insulation would not enter void areas as large as the void areas V' in the FIG. 1 prior art construction.

Figure 3:
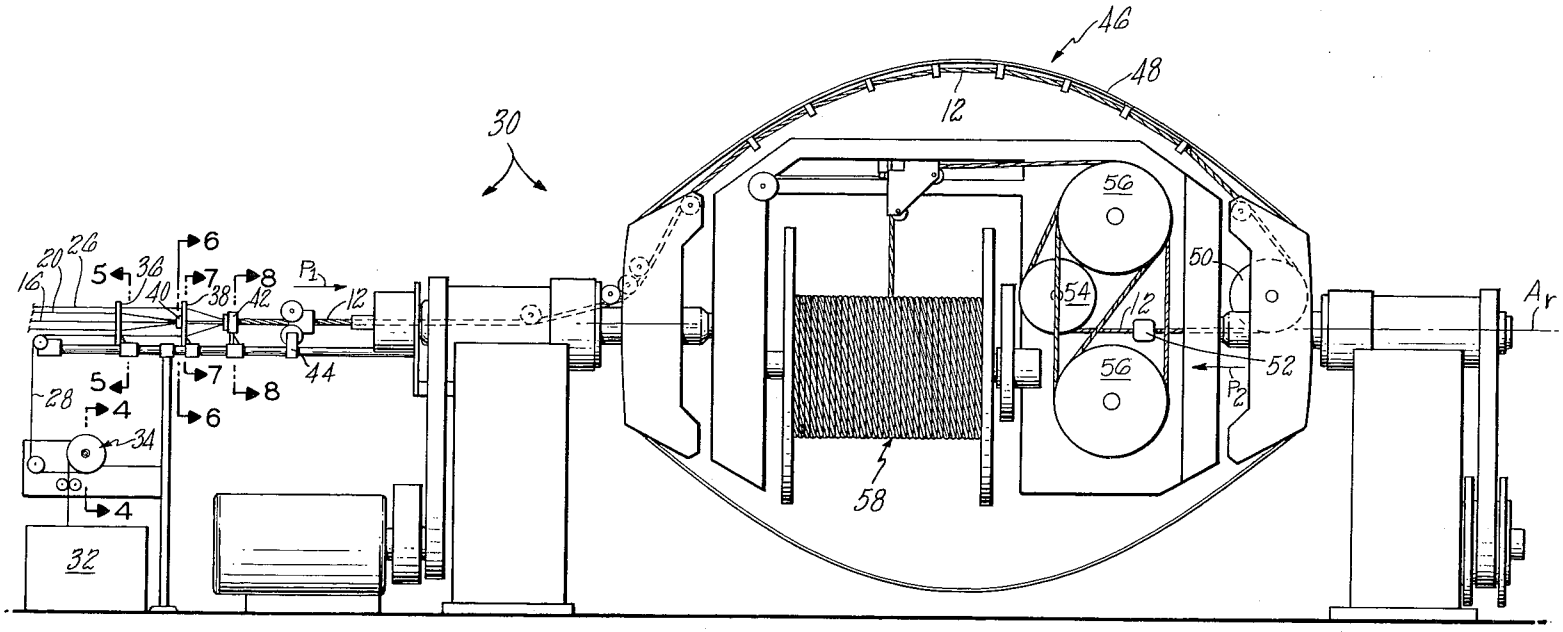
FIG. 3 is a side elevation view of a double twist twisting machine.

FIG. 3 shows an apparatus 30 for making the conductor strand 12. The apparatus includes a supply of round solid wires, as represented by the single source of supply 32 for a single fourth wire 28. The source of supply for the thirteen (13) wires 16, 20, 26 each having a predetermined diameter $D_1$ and the five remaining smaller wires 28 each having a diameter $D_4$ are not shown. A tensioning device 34 for applying tension to the fourth wire receives wire from the source of supply. Each wire has an independent tensioning device of the type 34. The apparatus has a first lay plate 36, a second lay plate 38, a first closing die 40 and a second closing die 42. A counter 44 is provided to measure the length of wire fabricated.

The apparatus 30 for making the conductor strand also includes a double twist stranding machine 46 of the type, for example, manufactured by O. M. Lesmo spa of Milan, Italy distributed in the United States by MacDraw Inc. of Williamsport, Md. as model numbers DTO-40 and DTO-80C. The double twist stranding machine has a axis of rotation $A_r$ and a flyer 48 which is driven by the machine about the axis of rotation. A first sheave 50 is adapted to receive the wire from the flyer and is rotatable with the flyer about the axis of rotation $A_r$. A guide die 52 has an opening equal to or greater than the diameter of the helically wound conductor strand and is adapted to guide the conductor strand as it comes off the first sheave. A second sheave 54 is adapted to receive the stranded conductor. The second sheave is not rotatable about the axis of rotation. A capstan unit 56 for exerting a force on the conductor strand to pass the conductor strand through the apparatus 30 is adapted to engage the wire. A take-up reel 58 receives the conductor strand.

FIG. 4 is a cross-sectional view taken along the lines 4—4 of FIG. 3 and shows the tensioning device 34 in more detail. The tensioning device includes a support 60 and a shaft 62. A sheave 64 having a groove 66 is rotatable about the shaft. A clutch material 68 for producing a frictional force proportional to the normal load of the sheave on the clutch material is disposed between the sheave and the support.

A means for applying a normal force to the sheave to urge the sheave against the clutch material such as the nut and spring combination 70 is used to vary the amount of force needed to cause the sheave to rotate. A thrust bearing 72 is disposed between the spring and the sheave. The frictional force between the wire and the sheave causes the sheave to rotate and to exert the preselected tensile force on the wire.

FIG. 5 is a view taken along the line 5—5 of FIG. 3 and shows the first lay plate 36. The lay plate is adapted by 19 holes which correspond to the first wire 16, the inner layer of wires 18 and the outer layer of wires 24 for guiding the wires. The diameter of the holes in the lay plate is many times larger than the diameter of the largest wire passing through the lay plate.

Figure 7:
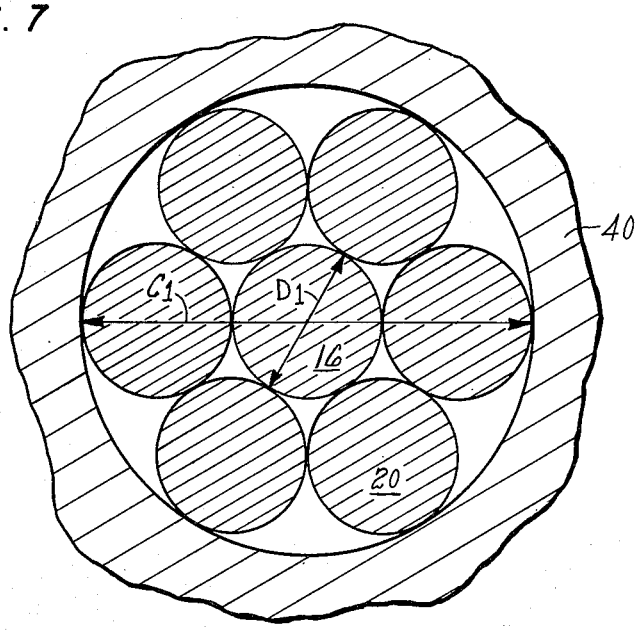
FIG. 7 is a cross-sectional view taken along the lines 7—7 of FIG. 3 showing the first closing die with a portion of the first closing die broken away for clarity.

FIG. 6 is a view taken along the lines 6—6 of FIG. 3 and show the second lay plate 38. The second lay plate has the first closing die 40 integrally formed with the lay plate. The internal diameter $C_1$ is approximately equal to three times the diameter $D_1$ of the first wire 16 and is equal to or slightly less than the diameter $C_1$ such that each second wire tangentially engages the first closing die as shown in FIG. 7 to prevent circumferential movement of the wires with respect to the die without substantially changing the shape or diameter of the wires passing through the die. As will be realized this might cause some minute or microscopic deformation of the surfaces of the wires that are in contact with the die.

Figure 8:
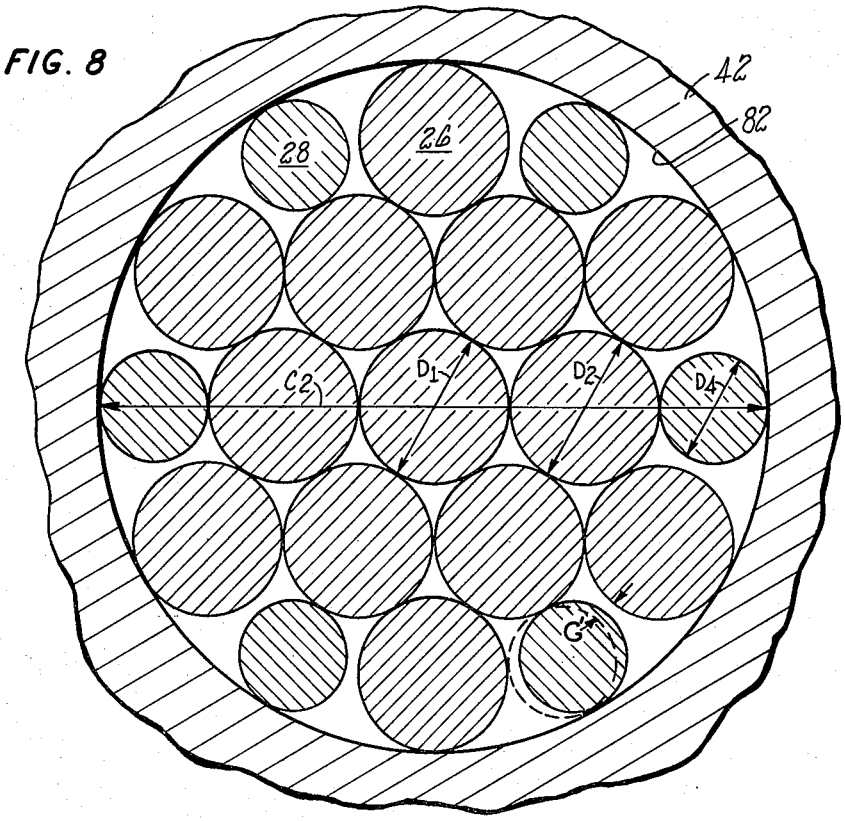
FIG. 8 is a cross-sectional view taken along the lines 8—8 of FIG. 3 showing the second closing die with a portion of the second closing die broken away for clarity.

FIG. 8 is a view taken along the lines 8—8 of FIG. 3 showing the second closing die 42 with a portion of the closing die broken away. The second closing die has a bore 82 which adapts the closing die to receive the cable. The bore diameter $C_2$ is approximately equal to but less than the summation of three times the diameter $D_1$ of the first, second and third wires and two times the diameter $D_4$ of the fourth wire. Each of the third wires and each of the fourth wires are capable of tangentially engaging the second closing die to prevent circumferential movement of the wires with respect to the die without substantially changing the shape or diameter of the wires as the wires pass through the second closing die. As will be realized even if one of the fourth wires moves to the broken line position, the wire will still be engaged by the die. In one construction for making twelve American Wire Gage (12 AWG) wire, the diameter $D_1$ was two-hundred and one ten-thousandths (0.0201) of an inch, the diameter $D_2$ was one-hundred and forty-seven ten-thousandths (0.0147) of an inch and a movement of the fourth wire toward the broken line position resulted in a diameter decrease of only sixty-millionths ($6\times10^{-5}$ inches) of an inch.

The apparatus 30 for forming the conductor strand 12 is used for strands having a substantially circular cross-sectional configuration and a size in the gage range from 20 AWG to 0000 AWG. The method includes the steps of providing a supply of round, solid wires which comprises thirteen (13) wires each having a predetermined diameter $D_1$ and six smaller wires each having a diameter $D_4$. The diameter $D_4$ lies in the range of sixty-eight percent (68%) to seventy-eight percent (78%) of the diameter $D_1$ of the first wire. The best results have been obtained using a diameter $D_4$ equal to 73.2% of the diameter $D_1$ with a tolerance of plus or minus five-tenths of 1%, i.e. $D_4=0.732\pm0.005\ D_1$.

The next step is applying a first unit tension $T_1$ to the first wire 16, a second unit tension $T_2$ to each second wire 20 which is approximately 80% of the unit tension $T_1$, and a third unit tension $T_3$ to each third and fourth wire 26, 28 which is approximately eighty percent (80%) of the unit tension $T_2$. In forming a nineteen wire conductor strand from wires having a diameter $D_1$ and 0.732 $D_1$, the following tensions were found acceptable: for the first wire 16, a first unit tension $T_1$ of five and four-tenths kilograms per square millimeter ($T_1=5.4$ Kg./mm$^2$); for the second wire 20, a second unit tension $T_2$ of four kilograms per square millimeter ($T_2=4.0$ kg./mm$^2$); and, for each third and fourth wire, a third unit tension of three and two-tenths kilograms per square millimeter (3.2 Kg/mm$^2$). The wires are passed through the first lay plate 36 as best shown in FIG. 5 to dispose the six second wires about the first wire and to dispose the six third wires and the six fourth wires about the six second wires.

As shown in FIG. 6, the six second wires 20 are assembled circumferentially about the first wire 16 in a first layer at the entrance to the first closing die 40. The third and fourth wires 26, 28 are kept in their relative positions with respect to the first lay plate by the second lay plate 38 which is integrally formed with the first closing die.

As the assembled second wires 20 and first wires 16 are passed in a first axial direction $P_1$ through the first closing die 40 at a first location, each second wire is tangentially engaged by the first closing die to prevent circumferential movement of the wires with respect to the die. As the flyer is driven about the axis of rotation $A_r$ in a first rotational direction R, the second wires are twisted helically about the first wire with a second lay having a length greater than the first lay but having the same lay direction as the first lay to form the core 22.

As the six third wires 26 and the six fourth wires 28 pass through the second lay plate 38, the six third wires and the six fourth wires are disposed about the core 22 and each fourth wire is disposed circumferentially between a pair of third wires. The core is then passed to a second location at the second closing die 42. As the core and the six third wires and six fourth wires enter the second closing die, the six third wires and the six fourth wires are assembled circumferentially about the core in a manner analogous to the manner in which the first and second wires are assembled at the first closing die. As the six third wires, the six fourth wires and the core are passed to a second location in the closing die, each third wire and each fourth wire is capable of tangentially engaging the second closing die to prevent circumferential movement of the wires with respect to the die. The six third wires and the six fourth wires are twisted helically at the second closing die about the core with a lay having the same length and having the same lay direction as the second lay to form a conductor strand having a lay which is equal to the second lay.

The conductor strand is passed through the flyer 48 to the first sheave 50. As the conductor strand is passed through the flyer, the flyer is rotated about the axis of rotation $A_r$. The conductor strand rotates about $A_r$ with the flyer. The rotation of the conductor strand about $A_r$ causes the second wires 20 to twist helically about the first wire in a first rotational direction at the first location in the first closing die and causes the third wires 26 and the fourth wires 28 to twist helically about the core 22 at the second location in the second closing die. The conductor strand is passed from the flyer to the first sheave 50 and thence in a direction $P_2$ opposite to the first axial direction $P_1$ through the guide die 52. The guide die has a diameter which is equal to or greater than the diameter of the maximum diameter of the conductor strand having the second lay.

As the strand is passed from the first sheave 50 to the second sheave 54 the frictional forces which exist between the conductor strand and the sheaves causes the first sheave to twist the conductor strand once again, completing a second twist of the strand. The second twist causes helical twisting at a third location between the first sheave and the second sheave of the six fourth wires, the six third wires, and the six second wires about the first wire in the same direction as the second lay to reduce the second lay to the first lay thereby forming a conductor strand having a first lay. The wires are passed through the capstan unit 56 which pulls the wire from the source of supply of the wire 32 and which feeds the wire to a take-up reel. The take-up reel is driven in conjunction with the capstan to receive the conductor strand as it is fed from the capstan unit. By placing the stranded conductor on the take-up reel, the stranded conductor is secured against untwisting.

As the wires initially pass into the apparatus 30 for forming the stranded conductor, an initial unit tension is supplied to each wire. The initial unit tension is the same for all wires of a given layer. by ensuring that each wire has the same opportunity to contact the closing dies as the adjacent wires in the layer, the tension is nearly uniformly increased in each wire in each layer as the wires pass through the closing dies. It is believed that the nearly uniform increases in the level of tension aids results in producing a substantially more uniform product than the nineteen wire conductors made with all equal diameter wires which must unevenly contact a circular die. Moreover, the spacing between the wires in the outer layer enables the wires to move in relation to each other when the second twist is applied and also accommodates movement of the wires with respect to each other as the wires pass through the flyer and from the first sheave to the second sheave. As the second twist is imparted to the outer layer, the outer layer exerts a compressive force on the inner layer. By reason of the tension in each wire and the spacing between the wires of the outer layer, the wires in the outer layer are freer to move longitudinally to accommodate any small changes in axial length which results from the second twist than if all the wires in the outer layer tangentially engage each other. This enables the strand to more effectively block the formation of high strands and to decrease any subsequent bird caging and wire breaks.

Although the invention has been shown and described with respect to detailed embodiments thereof, it should be understood by those skilled in the art that various changes in form and detail thereof may be made without departing from the spirit and the scope of the claimed invention.

I claim:

1. A method of making a conductor strand formed of solid wires, the conductor strand having a substantially circular cross-sectional configuration, the cross-sectional configuration having a size in the gage range from No. 20 AWG to No. 0000 AWG and comprising an inner layer consisting of six round wires helically applied about a central round wire, each wire of the inner layer having a first lay, and further comprising an outer layer consisting of six round third wires and six round fourth wires each disposed between a pair of third wires, the third and fourth wires being helically applied over the inner layer with a lay having the same length and directiion as the first lay, comprising the steps of:

providing a supply of round solid wires including thirteen (13) wires which include a first wire having a diameter $D_1$, six (6) second wires having a diameter equal to the diameter $D_1$ and six (6) third wires having a diameter equal to the diameter $D_1$ and including six (6) fourth wires having a diameter $D_4$ which is in a range of sixty-eight percent to seventy-eight percent of the diameter $D_1$, ($0.68\ D_1 \leqq D_4 \leqq 0.78\ D_1$);

applying a first unit tension $T_1$ to the first wire, a second unit tension $T_2$ to each second wire, and a third unit tension $T_3$ to each third wire and to each fourth wire, the unit tension $T_1$ being greater than the unit tension $T_2$, the unit tension $T_2$ being greater than the unit tension $T_3$;

disposing the six second wires circumferentially about the first wire in a first layer;

passing the wires to a first location;

twisting helically at the first location the six second wires circumferentially about the first wire with a second lay having a length greater than the first lay and having the same direction as the first lay to form a core at the first location;

passing the core to a second location;

disposing the six third wires and the six fourth wires circumferentially about the core before the core reaches the second location, the six fourth wires each being disposed between an adjacent pair of third wires;

twisting helically at the second location the six third wires and the six fourth wires circumferentially about the core with a lay having the same length as the second lay and having the same direction as the first lay to form a conductor strand having a lay which is equal to the second lay;

passing the conductor strand from the second location to a third location;

simultaneously twisting helically at the third location the six second wires, the six third wires, and the six fourth wires about the first wire in the same direction as the second lay to reduce the second lay to the first lay thereby forming a conductor strand having a first lay; and, securing the stranded conductor against untwisting;

wherein the difference in diameter between the third wires and the fourth wires provides a substantially circular cross-sectional shape and in combination with the different levels of unit tension facilitates manufacture of the wire by accommodating relative longitudinal movement of the layers to block the formation of high strands and wire breaks.

2. The method of making a conductor strand as claimed in claim 1 wherein the step of twisting helically at the first location includes the step of tangentially engaging said six second wires of the first layer to prevent circumferential movement of the first layer about the first wire and wherein the step of twisting helically at a second location includes the step of tangentially engaging the third wires and the fourth wires to prevent circumferential movement of the outer layer with respect to the inner layer.

3. The method of making a conductor strand as claimed in claim 2 wherein the unit tension $T_2$ is approximately eighty percent of the unit tension $T_1$, and the unit tension $T_3$ is approximately equal to eighty percent of the unit tension $T_2$.

4. The method of making a conductor strand as claimed in claim 3 wherein the unit tension $T_1$ is five and four-tenths kilograms per square millimeter ($T_1 = 5.4$ Kg./mm$^2$).

5. A method of making a conductor strand formed of solid wires, the conductor strand having a substantially circular cross-sectional configuration, the cross-sectional configuration having a size in the gage range from No. 20 AWG to No. 0000 AWG and comprising an inner layer consisting of six round wires helically applied about a central round wire, each wire of the inner layer having a first lay, and further comprising an outer layer consisting of six round third wires and six round fourth wires each disposed between a pair of third wires, the third and fourth wires being helically applied over the inner layer with a lay having the same length and running in the same direction as the first lay, comprising the steps of:

providing a supply of round solid wires comprising thirteen (13) wires which includes a first wire having a diameter $D_1$, six (6) second wires having a diameter equal to the diameter $D_1$ and six (6) third wires having a diameter equal to the diameter $D_1$ and including six (6) fourth wires each having a diameter $D_4$ which is approximately seventy-three and two-tenths of a percent of the diameter $D_1$ ($D_4 \approx 0.732\ D_1$);

applying a first unit tension $T_1$ of five and four tenths kilograms per square millimeter ($T_1 = 5.4$ Kg./mm$^2$) to the first wire, a second unit tension $T_2$ of four kilograms per square millimeter ($T_2 = 4.0$ kg./mm$^2$) to each second wire, and a third unit tension $T_3$ of three and two-tenths kilograms per square millimeter (3.2 Kg./mm$^2$) to each third and fourth wire;

passing all of the wires through a first lay plate to dispose the six second wires about the first wire and to dispose the six third wires and the six fourth wires about the six second wires;

assembling the six second wires circumferentially about the first wire in a first layer;

passing in a first axial direction the assembled second wires and first wire through a first closing die at a first location, the first closing die having a bore diameter $C_1$ approximately equal to three times the diameter $D_1$ ($C_1 \approx 3D_1$) such that each second wire tangentially engages the first closing die to prevent circumferential movement of the wires with respect to the die without substantially changing the shape or diameter of the wires passing through the first closing die;

twisting helically at the closing die at the first location the six second wires circumferentially about the first wire with a second lay which has a length greater than the first lay and which runs in the same direction as the first lay to form a core;

passing the six third wires and the six fourth wires through a second lay plate to dispose the six third wires and the six fourth wires about the core;

passing the core to a second location;

assembling the six third wires and the six fourth wires circumferentially about the core before the core reaches the second location, the six fourth wires each being disposed between an adjacent pair of third wires;

passing in the first axial direction all of the assembled wires through a second closing die at a second location, the second closing die having a bore diameter $C_2$ approximately equal to 4.46 times the diameter $D_1$ ($C_2 \approx 4.46\ D_1$) such that each of the third wires and each of the fourth wires are capable of tangentially engaging the second closing die to prevent circumferential movement of the third and fourth wires with respect to the die without substantially changing the shape or diameter of the third and fourth wires as the wires pass through the second closing die;

twisting helically at the second closing die at the second location the six third wires and the six fourth wires circumferentially about the core with a lay having the same length as the second lay and having the same direction as the first lay to form a conductor strand having a lay which is equal to the second lay;

passing the conductor strand from the second location to a third location;

rotating the conductor strand about an axis of rotation Ar a first time as the wire passes from the second location to the third location to twist the wires in a first rotational direction at the first location and the second location;

passing the conductor strand in a direction opposite to the first axial direction through a guide die, the guide die having a bore diameter $C_3$ which is at least equal to the maximum diameter of the conductor strand having the second lay;

rotating the fourth wires, the third wires and the second wires in the first rotational direction a second time aout the axis of rotation $A_r$ to simultaneously twist helically at the third location the six second wires, the six third wires, and the six fourth wires about the first wire in the same direction as the second lay to reduce the second lay to the first lay thereby forming a conductor strand having the first lay; and, securing the stranded conductor against untwisting.

6. The method of forming a conductor strand of claim 5 wherein a double twist stranding machine is employed, the machine having a take-up reel, a flyer rotatable about the axis of rotation $A_r$, a first sheave, and a capstan unit for exerting a force on the conductor strand to pass the wires through the closing dies and to the take-up reel and wherein the first sheave is rotatable with the flyer, wherein the step of rotating the conductor strand about the axis of rotation $A_r$ a first time includes the step passing the conductor strand onto the flyer and driving the flyer about the axis of rotation $A_r$;

wherein the step of helically twisting the conductor strand at the third location includes the step of rotating the first sheave about the axis of rotation $A_r$; and wherein the step of securing the conductor strand against untwisting includes the step of winding the conductor strand on the take-up reel.

7. A method of making an electric cable which includes a conductor strand formed of solid wires, the conductor strand having a substantially circular cross-sectional configuration, the cross-sectional configuration having a size in the gage range from No. 20 AWG to No. 0000 AWG and comprising an inner layer consisting of six round wires helically applied about a central round wire, each wire of the inner layer having a first lay, and further comprising an outer layer consisting of six round third wires and six round fourth wires each disposed between a pair of third wires, the third and fourth wires being helically applied over the inner layer with a lay having the same length and direction as the first lay, comprising the steps of:

providing a supply of round solid wires including thirteen (13) wires which include a first wire having a diameter $D_1$, six (6) second wires having a diameter equal to the diameter $D_1$ and six (6) third wires having a diameter equal to the diameter $D_1$ and including six (6) fourth wires having a diameter $D_4$ which is in a range of sixty-eight percent to seventy-eight percent of the diameter $D_1$, ($0.68D_1 \leqq D_4 \leqq 0.78D_1$);

applying a first unit tension $T_1$ to the first wire, a second unit tension $T_2$ to each second wire, and a third unit tension $T_3$ to each third wire and to each fourth wire, the unit tension $T_1$ being greater than the unit tension $T_2$, the unit tension $T_2$ being greater than the unit tension $T_3$;

disposing the six second wires circumferentially about the first wire in a first layer;

passing the wires to a first location;

twisting helically at the first location the six second wires circumferentially about the first wire with a second lay having a length greater than the first lay and having the same direction as the first lay to form a core at the first location;

passing the core to a second location;

disposing the six third wires and the six fourth wires circumferentially about the core before the core reaches the second location, the six fourth wires each being disposed between an adjacent pair of third wires;

twisting helically at the second location the six third wires and the six fourth wires circumferentially about the core with a lay having the same length as the second lay and having the same direction as the first lay to form a conductor strand having a lay which is equal to the second lay;

passing the conductor strand from the second location to a third location;

simultaneously twisting helically at the third location the six second wires, the six third wires, and the six fourth wires about the first wire in the same direction as the second lay to reduce the second lay to the first lay thereby forming a conductor strand having a first lay;

securing the stranded conductor against untwisting; and, applying a layer of insulating material to the conductor strand;

wherein the difference in diameter between the third wires and the fourth wires provides a substantially circular cross-sectional shape and in combination with the different levels of unit tension facilitates manufacture of the wire by accommodating relative longitudinal movement of the layers to block the formation of high strands and wire breaks.

8. The method of making an electric cable of claim 7 wherein the step of applying the layer of insulating material to the cable includes the step of sleeving insulating material over the conductor strand.

9. A conductor strand of the type used in an electric cable, the conductor strand being formed of a plurality of round, solid wires, which comprises:

a core having a first wire having a diameter $D_1$ and a longitudinal axis $A_1$, six second wires helically wrapped about the first wire with a first lay, the lay running in a first direction and having a first length, each second wire having a diameter $D_2$ equal to the diameter $D_1$; and, an outer layer of twelve wires helically wrapped about the core with a lay having the same length and direction as the first lay, the outer layer having six third wires wrapped helically about the core and spaced circumferentially one from the other to form parts of third wires and to leave a circumferential gap G between each pair of adjacent third wires, each third wire having a diameter $D_3$ equal to the diameter $D_1$, six fourth wires each disposed between a pair of associated third wires in the gap G between the third wires, each of the fourth wires having a diameter $D_4$ which is in a range of sixty-eight percent (68%) to seventy-eight percent (78%) of the diameter $D_1$ of said first wire, ($0.68D_1 \leqq D_4 \leqq 0.78D_1$);

wherein at any section through the strand taken perpendicular to the axis $A_1$ the strand has a substantially circular outside cross-sectional configuration and each fourth wire is spaced away from at least one of the adjacent pair of third wires leaving a minimum gap therebetween which is greater than zero to increase the flexibility of the wire and to facilitate manufacture of the wire.

10. The conductor strand of claim 9 having nineteen wires wherein the cross-sectional configuration of the strand has a first size in a gage range from No. 20 AWG to No. 0000 AWG, each gage having a predetermined circular mil area $CMA_T$ which is the sum of the circular mil areas of the nineteen wires, wherein a diameter $D_5$ is the diameter of one of nineteen wires of equal diameter in a conductor strand having the same gage as the first size and wherein the diameter $D_4$ of each fourth wire is less than the diameter $D_5$ and the diameter $D_3$ of each third wire is greater than the diameter $D_5$.

11. The conductor strand of claim 10 wherein the diameter $D_4$ of the fourth wire is approximately 73.2% of the diameter $D_1$ of the first wire, ($D_4 \approx 0.732D_1$)

12. A conductor strand of the type used in an electric cable, the conductor strand being formed of a plurality of round, solid wires formed of an electric conductor material, which comprises:

a first wire having a longitudinal axis $A_1$ and a cross-sectional shape which is round, the first wire having a diameter $D_1$, an inner layer of six second wires disposed circumferentially about the first wire, each second wire having a cross-sectional shape which is round and which has a diameter $D_2$ equal to the diameter $D_1$, each second wire being helically wound about the first wire with a first lay, the first lay running in a first direction and having a first length, and, each second wire tangentially engaging the first wire and the adjacent pair of second wires;

an outer layer of twelve solid wires disposed circumferentially about the inner layer, the outer layer having six third wires disposed circumferentially about the inner layer, each third wire having a cross-sectional shape which is round and which has a diameter $D_3$ equal to the diameter $D_1$, each third wire being helically wound about the inner layer with a lay having the same length and direction as the first lay, each third wire tangentially engaging a pair of adjacent second wires, and each third wire being spaced circumferentially from the circumferentially adjacent third wires leaving a circumferential gap G between each pair of third wires;

six fourth wires, each fourth wire being disposed in an associated circumferential gap G with a lay having the same length and direction as the first lay and having a cross-sectional shape which is round and which has a diameter $D_4$ which is in a range of sixty eight percent (68%) to seventy-eight percent (78%) of the diameter $D_1$ of the first wire, ($0.68D_1 \leqq D_4 \leqq 0.78D_1$);

wherein at any section through the strand taken perpendicular to the longitudinal axis $A_1$ of the first wire, the fourth wire is spaced away from at least one of the third wires leaving a minimum gap therebetween which is greater than zero to increase the flexibility of the cable and to facilitate manufacture of the cable.

13. The conductor strand as claimed in claim 12 wherein at least one of said fourth wires tangentially engages one of said third wires at one section through the strand taken perpendicular to the longitudinal axis $A_1$.

14. The conductor strand as claimed in claim 13 wherein at said section each fourth wire tangentially engages one of said second wires.

15. The conductor strand as claimed in claim 14 wherein the diameter $D_4$ is approximately 73.2% of the diameter $D_1$.

16. The conductor strand as claimed in claim 12 wherein at least one of said fourth wires is spaced away from the pair of adjacent third wires at one section through the strand which is taken perpendicular to the longitudinal axis.

17. The conductor strand as claimed in claim 16 wherein at said section each fourth wire tangentially engages one of said second wires.

18. The conductor strand as claimed in claim 17 wherein the diameter $D_4$ is approximately 73.2% of the diameter $D_1$.

19. An electric cable which includes a conductor strand formed of a plurality of round, solid wires, which comprises:

a core having a first wire having a diameter $D_1$ and a longitudinal axis $A_1$, six second wires helically wrapped about the first wire with a first lay, the lay running in a first direction and having a first length, each second wire having a diameter $D_2$ equal to the diameter $D_1$;

an outer layer of twelve wires helically wrapped about the core with a lay having the same length and direction as the first lay, the outer layer having six third wires wrapped helically about the core and spaced circumferentially one from the other to form pairs of third wires and to leave a circumferential gap G between each pair of adjacent third wires, each third wire having a diameter $D_3$ equal to the diameter $D_1$, six fourth wires each disposed between a pair of associated third wires in the gap G between the third wires, each of the fourth wires having a diameter $D_4$ which is in a range of sixty-eight percent (68%) to seventy-eight percent (78%) of the diameter $D_1$ of said first wire, ($0.68D_1 \leqq D_4 \leqq 0.78D_1$); and, a layer of insulating material disposed about said third and fourth wires;

wherein at any section through the strand taken perpendicular to the axis $A_1$ the strand has a substantially circular outside cross-sectional configuration and each fourth wire spaced away from at least one of the adjacent pair of third wires leaving a minimum gap therebetween which is greater than zero to increase the flexibility of the wire and to facilitate manufacture of the wire.

20. The electric cable of claim 19 wherein the cross-sectional configuration of the strand has a first size in a gage range from no. 20 AWG to No. 0000 AWG, each gage having a predetermined circular mil area $CMA_T$ which is the sum of the circular mil areas of the nineteen wires, wherein a diameter $D_5$ is the diameter of one of nineteen wires of equal diameter in a conductor strand having the same gage as the first size and wherein the diameter $D_4$ of each fourth wire is less than the diameter $D_5$ and the diameter $D_3$ of each third wire is greater than the diameter $D_5$.

21. An electric cable having a conductor strand as claimed in claim 20 wherein the layer of insulating material is disposed circumferentially about the conductor strand and slidably engages the conductor strand.

22. An electric cable having a conductor strand as claimed in claim 20 wherein the diameter $D_4$ of the fourth wire is approximately 73.2% of the diameter $D_1$ of the first wire, ($D_4 \approx 0.732D_1$).

23. An electric cable having a conductor strand as claimed in claim 22 wherein the layer of insulating material is disposed circumferentially about the conductor strand and slidably engages the conductor strand.

24. An electric cable having a conductor strand which includes a plurality of round, solid wires formed of an electric conductor material, which comprises:

a first wire having a longitudinal axis $A_1$ and a cross-sectional shape which is round, the first wire having a diameter $D_1$, an inner layer of six second wires disposed circumferentially about the first wire, each second wire having a cross-sectional shape which is round and which has a diameter $D_2$ equal to the diameter $D_1$ each second wire being helically wound about the first wire with a first lay, the first lay running in a first direction and having a first length, and, each second wire tangentially engaging the first wire and the adjacent pair of second wires;

an outer layer of twelve solid wires disposed circumferentially about the inner layer, the outer layer having six third wires disposed circumferentially about the inner layer, each third wire having a cross-sectional shape which is round and which has a diameter $D_3$ equal to the diameter $D_1$, each third wire being helically wound about the inner layer with a lay having the same length and direction as the first lay, each third wire tangentially engaging a pair of adjacent second wires, and each third wire being spaced circumferentially from the circumferentially adjacent third wires leaving a circumferential gap G between each pair of third wires;

six fourth wires, each fourth wire being disposed in an associated circumferential gap G with a lay having the same length and direction as the first lay and having a cross-sectional shape which is round and which has a diameter $D_4$ which is in a range of sixty eight percent (68%) to seventy-eight percent (78%) of the diameter $D_1$ of the first wire, ($0.68D \leqq D_4 \leqq 0.78D_1$);

a layer of insulating material disposed about said third and fourth wires;

wherein at any section through the strand taken perpendicular to the longitudinal axis $A_1$ of the first wire, the fourth wire is spaced away from at least one of the third wires leaving a minimum gap therebetween which is greater than zero to increase the flexibility of the cable and to facilitate manufacture of the cable.

25. An electric cable as claimed in claim 24 wherein the layer of insulating material slidably engages the conductor strand.

* * * * *